US006550065B1

(12) United States Patent
Meyers

(10) Patent No.: US 6,550,065 B1
(45) Date of Patent: Apr. 22, 2003

(54) GLOVE TO PROTECT FINGERNAILS WHILE TANNING

(75) Inventor: Janet S. Meyers, Indianapolis, IN (US)

(73) Assignee: Philip D. Simpkins, Indianapolis, IN (US); a part interest ( * ) Notice: Subject to any disclaimer, the term of this patent is extended or adjusted under 35 U.S.C. 154(b) by 0 days.

(21) Appl. No.: 09/951,566

(22) Filed: Sep. 12, 2001

Related U.S. Application Data

(60) Provisional application No. 60/231,771, filed on Sep. 12, 2000.

(51) Int. Cl.[7] ..... A61F 9/00

(52) U.S. Cl. ..... 2/16; 2/163; 2/239

(58) Field of Search ..... 2/239, 159, 161.1, 2/161.2, 161.3, 161.4, 161.5, 161.6, 163, 16

(56) References Cited

U.S. PATENT DOCUMENTS

| | | | | |
|---|---|---|---|---|
| 4,785,478 A | * | 11/1988 | Mosley | 2/161 |
| 4,908,879 A | * | 3/1990 | Roderman | 2/161 |
| 5,817,143 A | * | 10/1998 | Perry | 607/88 |
| 6,350,168 B1 | * | 2/2002 | Kroll et al. | 441/111 |

* cited by examiner

*Primary Examiner*—John J. Calvert
*Assistant Examiner*—Katherine Moran
(74) *Attorney, Agent, or Firm*—Woodard, Emhardt, Naughton, Moriarty & McNett

(57) ABSTRACT

The present invention comprises a glove formed from a material that allows passage of ultraviolet rays, such that tanning of the wearer's skin through the glove is facilitated. Portions a the distal ends of the glove digits are covered by a material that is opaque to ultraviolet rays, thereby preventing discoloration of the wearer's nails.

14 Claims, 1 Drawing Sheet

GLOVE TO PROTECT FINGERNAILS WHILE TANNING

CROSS-REFERENCE TO RELATED APPLICATIONS

The present application claims priority under 35 U.S.C. §120 from U.S. Provisional Application Ser. No. 60/231,771, filed Sep. 12, 2000.

TECHNICAL FIELD OF THE INVENTION

The present invention generally relates to clothing and, more particularly, to gloves which protect the wearer's fingernails while tanning.

BACKGROUND OF THE INVENTION

Tanning, both naturally outdoors and artificially indoors, is a popular pastime. While tanning, a person exposes the surfaces of the skin to ultraviolet rays (either those produced by the sun or those produced by special tanning bulbs). Melanin in the skin reacts with the ultraviolet rays in order to produce a golden brown tone to the skin. It has been discovered that fingernails, both natural and, in particular, artificial fingernails react undesirably to the presence of ultraviolet rays, causing a yellowish or brownish discoloration thereto. There is therefore a need for a device that will allow the user to tan the skin without causing discoloration of the fingernails. The present invention is directed toward meeting this need.

SUMMARY OF THE INVENTION

The present invention comprises a glove formed from a material that allows passage of ultraviolet rays, such that tanning of the wearer's skin through the glove is facilitated. Portions a the distal ends of the glove digits are covered by a material that is opaque to ultraviolet rays, thereby preventing discoloration of the wearer's nails.

BRIEF DESCRIPTION OF THE PREFERRED EMBODIMENTS

Figure 1:
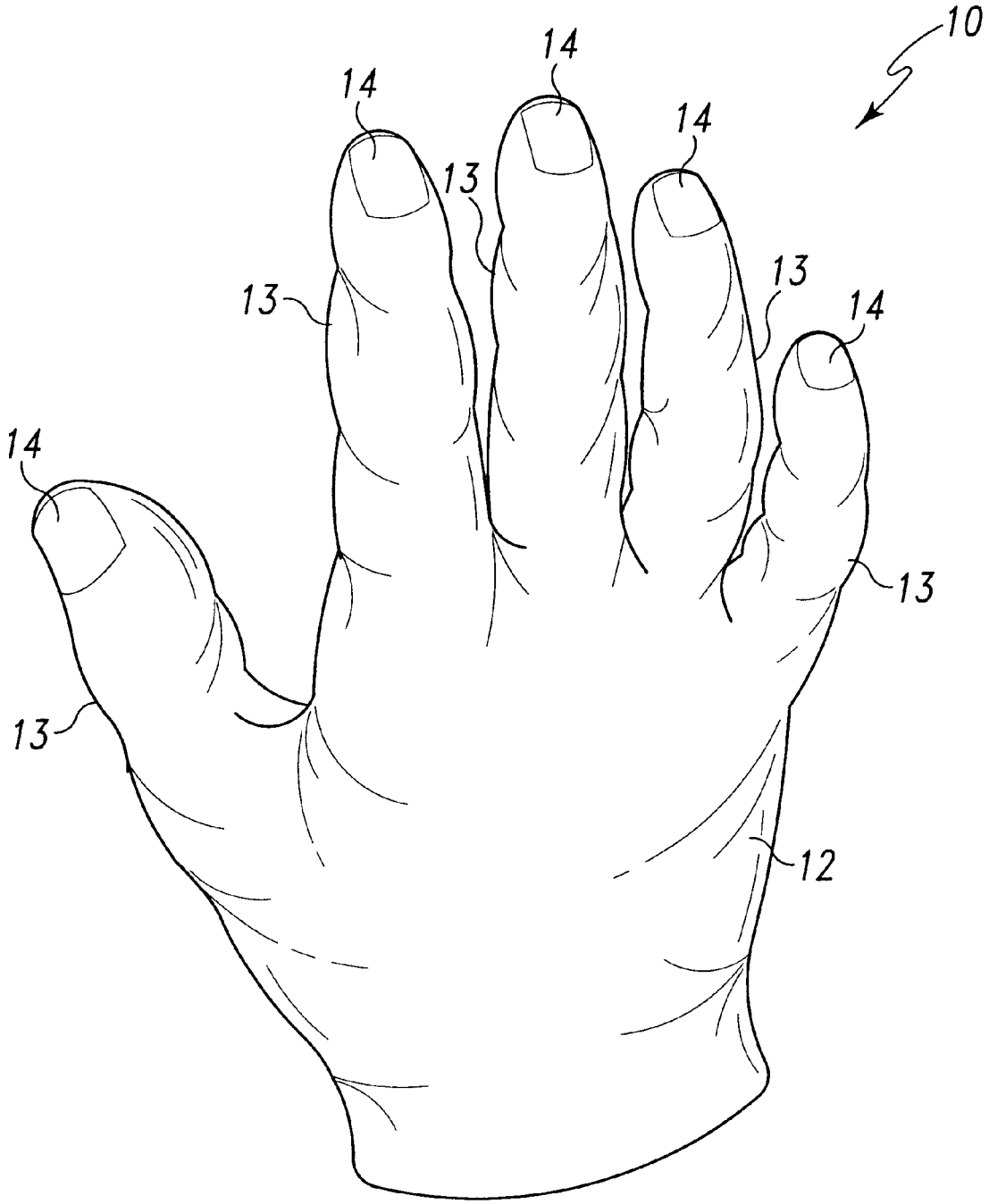
FIG. 1 is a top plan view of a preferred embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

The present invention solves the problem of fingernail discoloration by providing a glove to be worn by the tanner which allows the skin underneath the glove to receive ultraviolet rays for tanning, while protecting the fingernails from exposure to those ultraviolet rays. With reference to FIG. 1, there is shown a glove, indicated generally at 10, which has a body formed from a material 12 which is relatively transparent to ultraviolet rays. A variety of such materials are known in the art, and are commonly used in the manufacture of "tan-through" swimsuits. The glove 10 includes a plurality of digits 13, into which the fingers of the wearer's hand may be inserted. The glove 10 further contains nail areas 14 at the distal end of each digit 13 which are formed from a material that is substantially opaque to ultraviolet rays. The nail areas 14 are configured so as to substantially overlay the region on the wearer's hand occupied by the fingernail. The nail areas 14 may be formed from any suitable material that is substantially opaque to ultraviolet rays, such as fabric, plastic, metal, composite materials, etc. The composition of the material used to form nail area 14 is not critical, so long as it prevents a substantial amount of ultraviolet radiation from reaching the fingernail area of the wearer when the glove is exposed to ultraviolet radiation.

Furthermore, the attachment of the nail areas 14 to the material 12 is not critical to the present invention. The nail areas 14 may be inserted into openings in the material 12 and attached around their perimeters, as would be convenient if the nail areas 14 were formed from fabric. In such case, the fabric pieces of the nail areas 14 could be sewed around their perimeter to the material 12. However, the present invention also comprehends that the material of the nail areas 14 can overlay the material 12. In such an embodiment, the entire glove 10 would be formed from the material 12, and the nail areas 14 would simply be applied over the material 12 in the appropriate regions. It is also comprehended by the present invention that the glove 10 can be shaped and dimensioned so as to be worn on the user's foot in order to protect the toenails. No substantial change to the format shown in FIG. 1 would be required other than to correctly size the dimensions thereof in order to fit a foot and toes instead of a hand and fingers. Consequently, as used herein the term "glove" is intended to mean a garment that can be worn on the hand or foot, the term "digit" is intended to mean a portion of the glove for covering a finger or a toe, and the term "nail" is intended to mean a fingernail or toenail.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed:

1. A glove, comprising:

a body shaped to substantially cover a wearer's hand or foot and having a plurality of digits, an entirety of said body formed from a material that is relatively transparent to ultraviolet rays for tanning; and a plurality of nail areas formed from a material that is relatively opaque to ultraviolet rays for tanning;

wherein each of said plurality of nail areas is affixed at a distal end of a respective one of the plurality of digits.

2. The glove of claim 1, wherein said body is formed from fabric.

3. The glove of claim 1, wherein each of said plurality of nail areas is formed from fabric.

4. The glove of claim 3, wherein each of said plurality of nail areas is sewn to said body.

5. The glove of claim 1, wherein each of said plurality of nail areas is formed from plastic.

6. A glove, comprising:

a body shaped to substantially cover a wearer's hand or foot and having a plurality of digits, an entirety of said body formed from a material that allows tanning rays to pass therethrough; and a plurality of nails areas formed from a material that substantially prevents tanning rays from passing therethough;

wherein each of said plurality of nail areas is affixed at a distal end of a respective one of the plurality of digits.

7. The glove of claim 6, wherein said body is formed from fabric.

8. The glove of claim 6, wherein each of said plurality of nail areas is formed from fabric.

9. The glove of claim 8, wherein each of said plurality of nail areas is sewn to said body.

10. The glove of claim 6, wherein each of said plurality of nail areas is formed from plastic.

11. A glove, comprising:

a shaped to substantially cover a wearer's hand or foot and body having a plurality of digits, an entirety of said body formed from a material that is relatively transparent to tanning rays; and a plurality of nail areas formed from a material that is relatively opaque to tanning rays;

wherein each of said plurality of nail areas is affixed at a distal end of a respective one of the plurality of digits.

12. The glove of claim 11, wherein said body is formed from fabric.

13. The glove of claim 11, wherein each of said plurality of nail areas is formed from fabric.

14. The glove of claim 13, wherein each of said plurality of nail areas is formed from plastic.

* * * * *